US005321469A

United States Patent [19]

Ahn

[11] Patent Number: 5,321,469

[45] Date of Patent: Jun. 14, 1994

[54] GEARING ARRANGEMENT FOR DRIVING A PHOTO-SENSITIVE DRUM OF AN ELECTRO-PHOTOGRAPHY PROCESS UNIT

[75] Inventor: Byeong-Sun Ahn, Kyungki-do, Rep. of Korea

[73] Assignee: SamSung Electronics Co., Ltd., Kyungki-do, Rep. of Korea

[21] Appl. No.: 975,726

[22] Filed: Nov. 13, 1992

[30] Foreign Application Priority Data

Nov. 25, 1991 [KR] Rep. of Korea ..... 21140

[51] Int. Cl.[5] ..... G03G 5/00

[52] U.S. Cl. ..... 355/211; 355/200; 355/245

[58] Field of Search ..... 355/200, 210, 211, 245, 355/251; 118/656-658; 464/180

[56] References Cited

U.S. PATENT DOCUMENTS

| | | | |
|---|---|---|---|
| 4,951,093 | 8/1990 | Ishii et al. | 355/245 |
| 4,975,743 | 12/1990 | Surti | 355/211 |
| 5,070,366 | 12/1991 | Tsuchiya | 355/219 |
| 5,126,800 | 6/1992 | Shishido et al. | 355/211 |
| 5,132,728 | 5/1990 | Suzaki et al. | 355/200 |

FOREIGN PATENT DOCUMENTS

| | | | |
|---|---|---|---|
| 0266946 | 5/1988 | European Pat. Off. | 355/245 |
| 0245271 | 10/1987 | Japan | 355/211 |
| 63-139372 | 6/1988 | Japan | 355/211 |
| 1-277867 | 11/1989 | Japan | 355/245 |
| 1-277869 | 11/1989 | Japan | 355/245 |
| 3-75767 | 3/1991 | Japan | 355/245 |
| 3-251873 | 11/1991 | Japan | 355/245 |
| 0026864 | 1/1992 | Japan | 355/211 |
| 4-42255 | 2/1992 | Japan | 355/245 |
| 2084334 | 4/1982 | United Kingdom . | |

*Primary Examiner*—A. T. Grimley
*Assistant Examiner*—William J. Royer
*Attorney, Agent, or Firm*—Robert E. Bushnell

[57] ABSTRACT

A gearing arrangement for driving a photosensitive drum of an electrophotography process unit including a first drum gear mounted on one end of a shaft of a photosensitive drum for receiving the motion of a drive gear of a motor, a second drum gear mounted on the other end of the shaft of the photosensitive drum, a first gearing assembly connected with the first drum gear, and a second gearing assembly connected with the second drum gear, wherein the first and second gearing assemblies serve to uniformly distribute the torque of the drive gear.

3 Claims, 5 Drawing Sheets

GEARING ARRANGEMENT FOR DRIVING A PHOTO-SENSITIVE DRUM OF AN ELECTRO-PHOTOGRAPHY PROCESS UNIT

TECHNICAL BACKGROUND

The present invention relates to a gearing arrangement for driving a photosensitive drum of an electrophotography process unit.

Referring to FIG. 1 for illustrating a conventional electrophotography process unit, the surface of a photosensitive drum 28 is uniformly charged with a constant voltage by an electric charger 25 and then exposed to the light of a lamp 22 reflected from an original document placed on a platen glass 21, so that an electrostatic latent image is formed on the photosensitive drum 28 corresponding to the image of the document. The light source may be a laser scanning unit, light emitting diode, etc. Thereafter, as the photosensitive drum 28 is rotated, the toner of a developer 27 is attracted to the surface of the photosensitive drum 28 so as to develop the latent image transferred by a transfer means 32 to a sheet of paper supplied by a supply roll 20.

The paper adhering to the photosensitive drum 28 by the electrostatic force is separated by a separator 33 therefrom. Then the paper is conveyed by a conveyor belt 30 to a fixing means 40, where the paper is heated and pressed between a heat roll 35 and pressure roll 34 to fix the toner, conveyed to a discharging tray 39.

The residual toner on the photosensitive drum 28 is removed by a cleaning blade 29 and the latent image is canceled by the light supplied from a pre-erase lamp array 37.

Referring to FIGS. 3A and 3B, the rotation of the drum 28 is made by the rotational force of the drive gear 22 of a motor, which rotational force is transmitted to the drum 28 by means of a pulley **22*a* attached to the shaft of the drive gear 22, a pulley 44 attached to the shaft of an idle gear 43, and a timing belt 45 connecting the pulleys 22*a* and 44. The idle gear 43 is engaged with a first drum gear 28*a* mounted on one end of the shaft of the drum 28. The drive gear 22 is engaged with an idle gear 41 of different pitch. An idle gear 42 is engaged with the idle gears 41 and 43. A magnet roll drive gear 27*a* mounted on one end of the shaft of a magnet roll 27*b* is engaged with an idle gear 46 which in turn is engaged with the idle gear 43. The magnet roll 29*b* is installed in the developer 27**.

Such conventional gearing arrangement for transmitting the torque of a servo motor to the drum and developer is very complicated requiring the timing belt. Moreover all the driving components are positioned only in one side of the drum, so that the torque is concentrated in that side of the drum to make unstable the gap between the drum and developer, thereby degrading the picture quality of document reproduction.

SUMMARY OF THE INVENTION

It is an object of the present invention to provide a gearing arrangement for driving a photosensitive drum of a electrophotography process unit, which is divided into two parts to uniformly distribute the drive torque over the drum so as to make stable the gap between the drum and developer.

According to the present invention, a gearing arrangement for driving a photosensitive drum of an electrophotography process unit comprises a first drum gear mounted on one end of a shaft of a photosensitive drum for receiving the motion of a drive gear of a motor, a second drum gear mounted on the other end of the shaft of the photosensitive drum, a first gearing means connected with the first drum gear, and a second gearing means connected with the second drum gear, wherein the first and second gearing means serve to uniformly distribute the torque of the drive gear. The present invention will now be described more specifically with reference to the drawings attached only by way of example.

BRIEF DESCRIPTION OF ATTACHED DRAWINGS

DETAILED DESCRIPTION OF A CERTAIN PREFERRED EMBODIMENT

Figure 1:
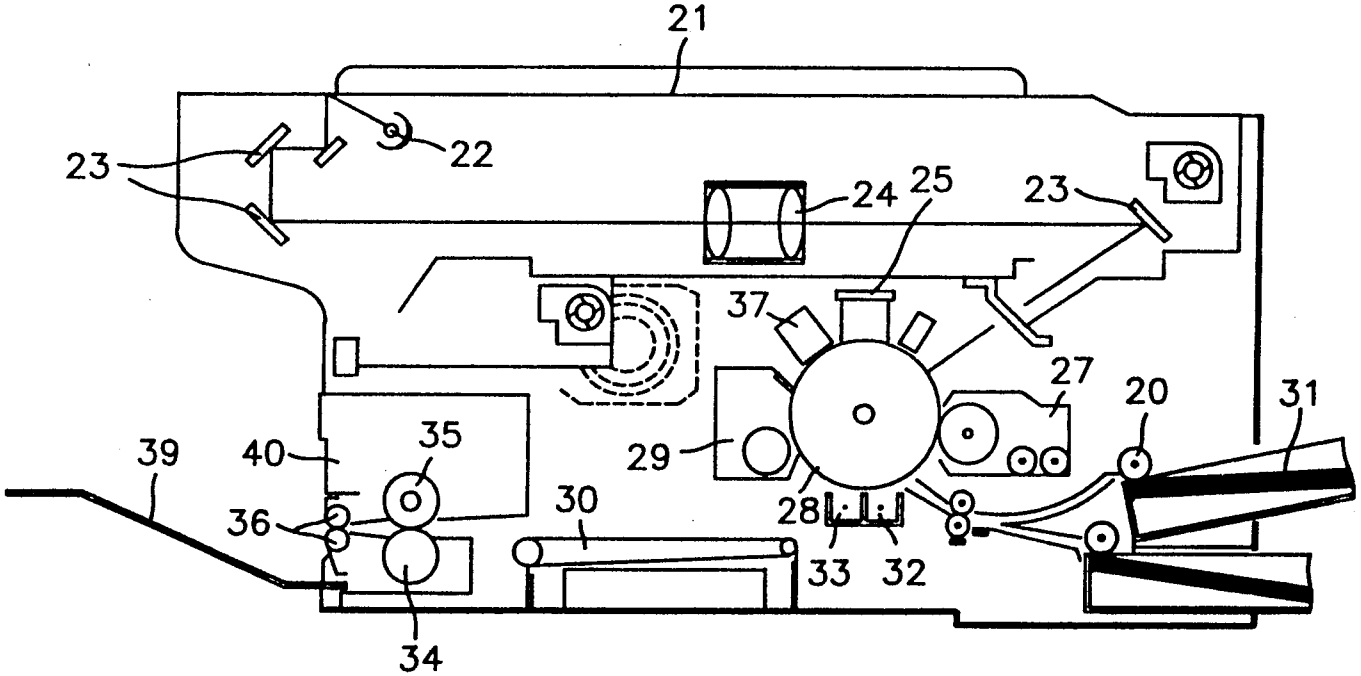
(PRIOR ART) FIG. 1
FIG. 1 is a schematic diagram for illustrating the structure of a conventional electrophotography process unit.
Figure 2:
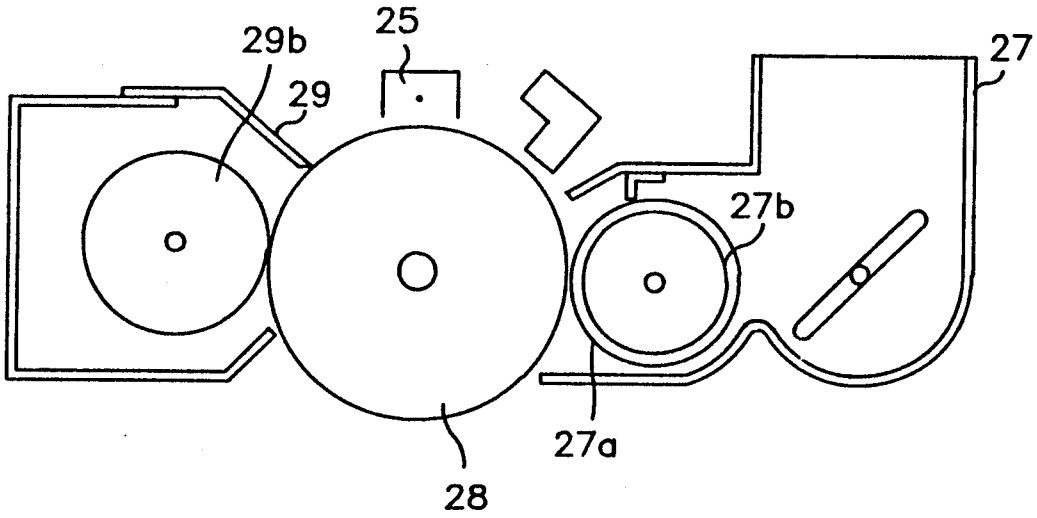
(PRIOR ART) FIG. 2
FIG. 2 is an enlarged side view of a part of FIG. 1.
Figure 3A:
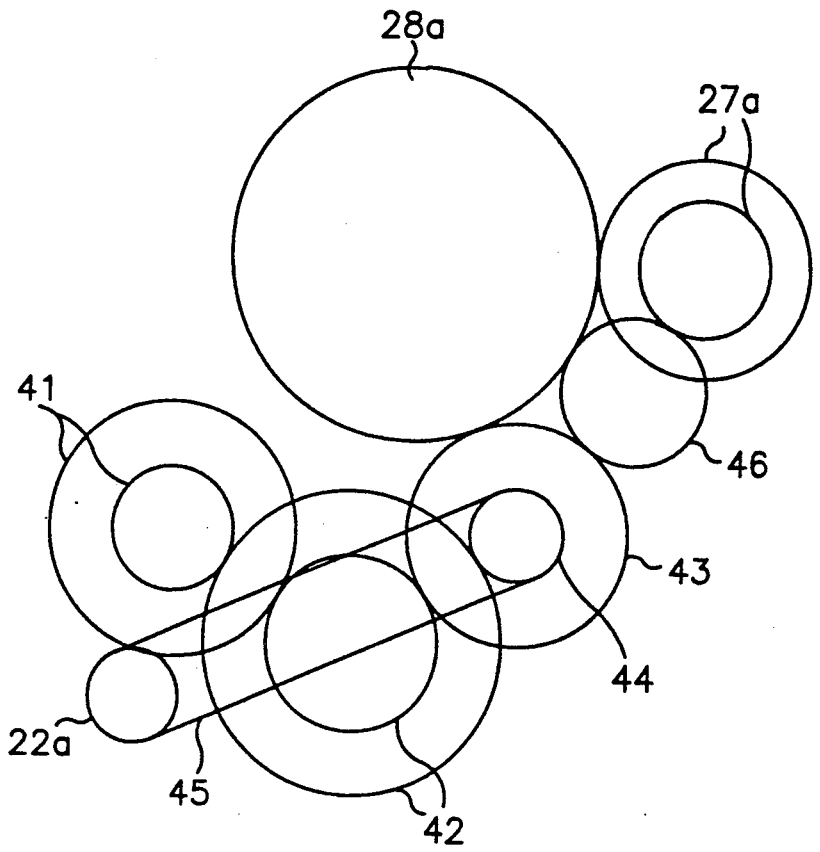
(PRIOR ART) FIG. 3A
FIG. 3A is a schematic plane view of a conventional gearing arrangement.
Figure 3B:
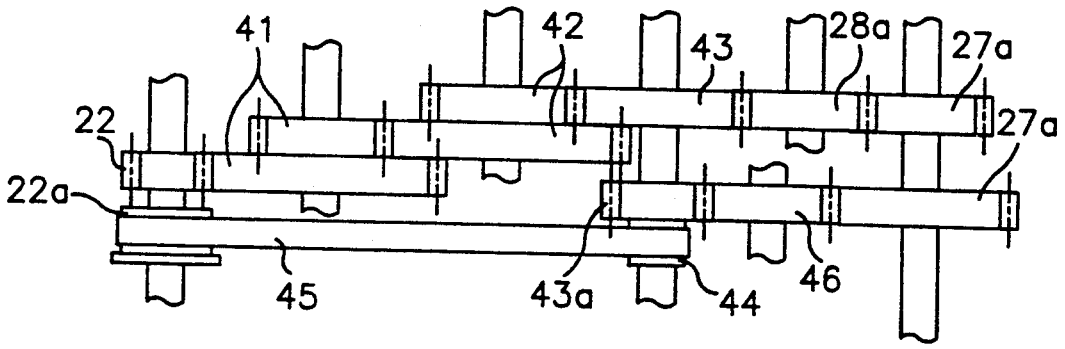
(PRIOR ART) FIG. 3B
FIG. 3B is an elevational view of FIG. 3A.
Figure 4:
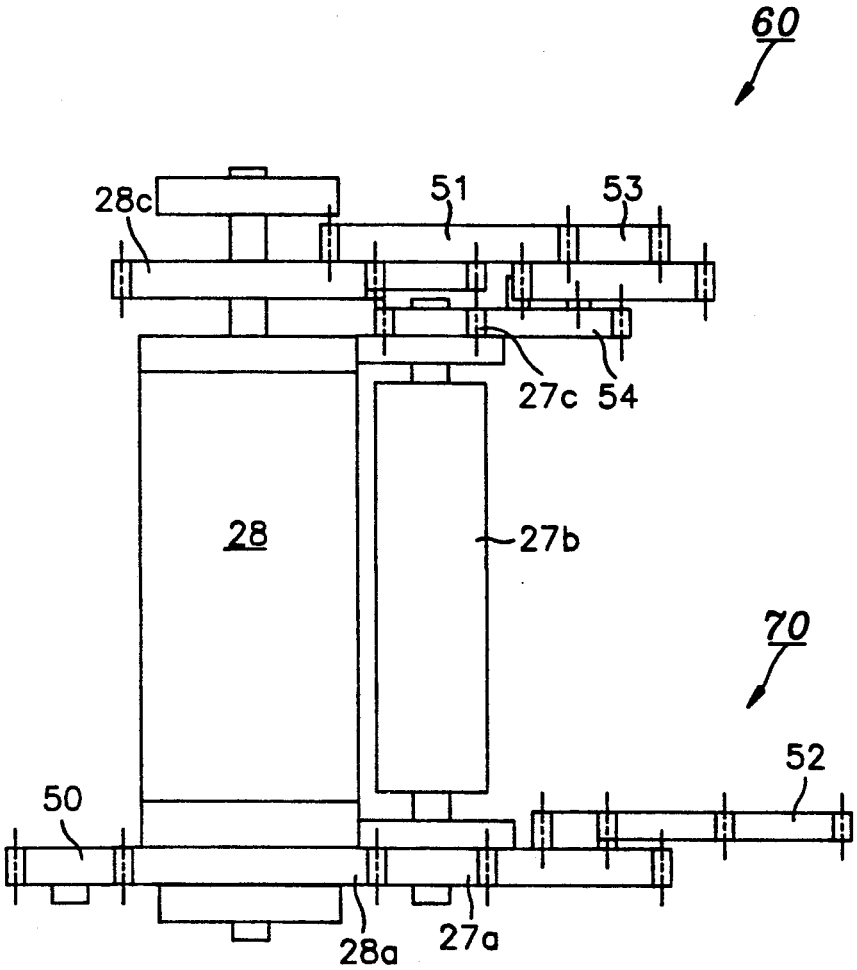
FIG. 4 is a schematic plane view of a gearing arrangement according to the present invention.
Figure 5A:
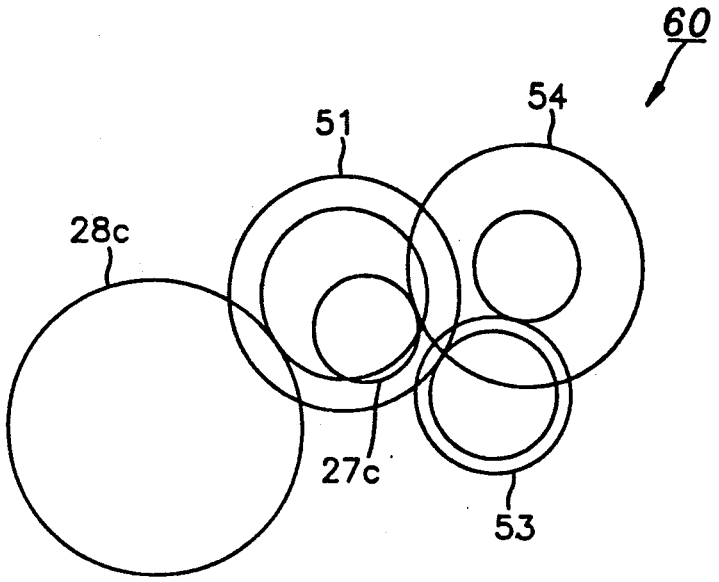
FIGS. 5A and 5B are schematic diagrams for illustrating the structure of the gearing arrangement of FIG. 4.
Figure 5B:
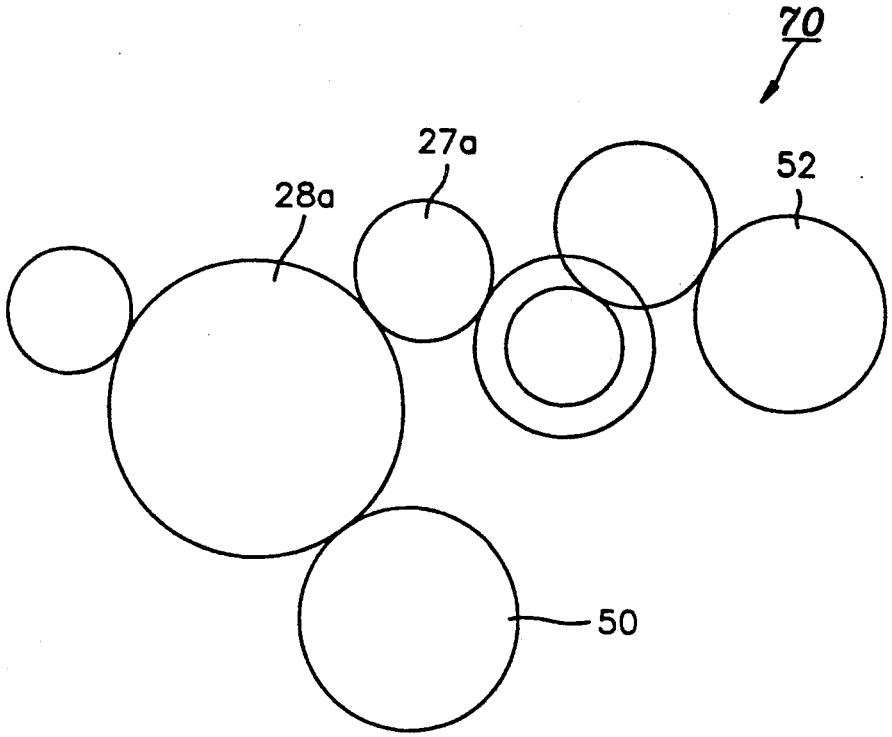

Referring to FIGS. 4, 5A and 5B, a photosensitive drum 28 has a first and second drum gears **28*a* and 28*c* respectively mounted on both ends of the shaft. The first drum gear 28*a* is engaged with a drive gear 50 constituting a first gearing means 70. The second drum gear 28*c* constitutes a second gearing means 60. The first gearing means includes a first magnet roll gear 27*a* of a magnet roll 27*b* of a developer 27 engaged with the first drum gear 28*a*, developer drive means, first idle gear 52, and intermediate gearing means for connecting the first magnet roll gear 27*a* with the developer drive means and first idle gear 52**.

The second gearing means 60 includes a second idle gear 51 engaged with the second drum gear **28*c* of different pitch, third idle gear 53 engaged with the second idle gear 51, fourth idle gear 54 engaged with the third idle gear 53, and a second magnet roll gear 27*c* of the magnet roll 27*b* engaged with the fourth idle gear 54**.

In operation, the drum 28 is rotated by the drive gear 50 of the drive motor driving the drum gear **28*a*. In this case the other drum gear, 28*c* is also rotated together with the drum 28. The magnet roll 27*b* of the developer 27 is rotated by the first magnet roll gear 27*a* that is driven by the first drum gear 28*a*. Of course, the intermediate gearing means transmits the torque of the first magnet roll gear 27*a* to the first idle gear 52. Meanwhile, the second drum gear 28*c* rotates the second idle gear 51 engaged with the third idle gear 53 so as to drive the fourth idle gear 54 and the second magnet roll gear 27*c***, so that the torque of the drive gear is uniformly distributed. As a result the gap between the drum and developer is kept stable improving the picture quality of document reproduction.

What is claimed is:

1. A gearing arrangement for driving a photosensitive drum of an electrophotography process unit comprising:

a first drum gear mounted on a first end of a shaft of said photosensitive drum for receiving motion of a drive gear of a motor;

a second drum gear mounted on a second end of said shaft of said photosensitive drum;

first gearing means connected with said first drum gear, said first gearing means comprising:

a first magnet roll gear of a magnet roll of a developer engaged with said first drum gear;

second gearing means connected with said second drum gear, wherein said first and second gearing means serve to uniformly distribute the torque of said drive gear, said second gearing means comprising:

a plurality of idler gears connected to said second drum gear wherein said plurality of idler gears speed-up a second magnet roll gear of said magnet roll of said developer.

2. A gearing arrangement for driving a photosensitive drum of an electrophotography process unit comprising:

a first drum gear mounted on a first end of a shaft of said photosensitive drum for receiving motion of a drive gear of a motor;

a second drum gear mounted on a second side of said shaft of said photosensitive drum;

first gearing means connected to said first drum gear, said first gearing means comprising:

developer drive means;

a first magnet roll gear of a magnet roll of said developer drive means, said first magnet roll gear connected with said first drum gear;

a first idler gear;

intermediate gearing means connecting said first magnet roll gear with said developer drive means and said first idler gear;

second gearing means connected to said second drum gear, wherein said first and second gearing means serve to uniformly distribute the torque of said drive gear, said second gearing means comprising:

a second idler gear connected with said second drum gear;

a third idler gear connected with said second idler gear;

a fourth idler gear connected with said third idler gear; and a second magnet roll gear of said magnet roll, said second magnet roll gear connected with said fourth idler gear.

3. A method for driving a photosensitive drum of an electrophotography process unit, comprising:

rotating a drive gear using a drive motor;

rotating first and second drum gears via engagement of said drive gear with said first drum gear;

rotating a magnet roll of a developer via engagement of a first magnet roll gear with said first drum gear;

transmitting torque of said first magnet roll gear to a first idler gear through intermediate gear means;

rotating a second idler gear via engagement of said second drum gear with said second idler gear;

rotating a third idler gear via engagement of said second idler gear with said third idler gear;

rotating a fourth idler gear via engagement of said third idler gear with said fourth idler gear;

rotating a second magnet roll gear via engagement of said fourth idler gear with said second magnet roll gear;

uniformly distributing torque of said drive gear through use of said first and second drum gears, said intermediate gear means, said first idler gear, said second idler gear, said third idler gear, said fourth idler gear, and said first and second magnet roll gears.

* * * * *